US008934797B2

(12) United States Patent
Miyahara et al.

(10) Patent No.: US 8,934,797 B2
(45) Date of Patent: Jan. 13, 2015

(54) IMAGE FORMING APPARATUS HAVING CONTROL DEVICE FOR APPLYING CONTROL BIASES TO COLLECTION MEMBERS

(71) Applicants: Kensuke Miyahara, Nagoya (JP); Masashi Imai, Kasugai (JP); Yoh Nishimura, Nagoya (JP)

(72) Inventors: Kensuke Miyahara, Nagoya (JP); Masashi Imai, Kasugai (JP); Yoh Nishimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 28 days.

(21) Appl. No.: 13/828,713

(22) Filed: Mar. 14, 2013

(65) Prior Publication Data

US 2013/0322902 A1 Dec. 5, 2013

(30) Foreign Application Priority Data

Jun. 1, 2012 (JP) ..... 2012-125849

(51) Int. Cl.

| | |
|---|---|
| ***G03G 15/01*** | (2006.01) |
| ***G03G 15/02*** | (2006.01) |
| ***G03G 15/16*** | (2006.01) |
| ***G03G 21/00*** | (2006.01) |

(52) U.S. Cl.

CPC ..... *G03G 15/0266* (2013.01); *G03G 15/0194* (2013.01); *G03G 21/0058* (2013.01)

USPC ..... 399/50; 399/66; 399/71; 399/82; 399/101

(58) Field of Classification Search

CPC ... G03G 15/01; G03G 15/0266; G03G 15/80; G03G 21/00; G03G 21/0005; G03G 21/0058; G03G 2215/1661; G03G 2221/0005; G03G 2221/0026

USPC ..... 399/50, 46, 71, 82, 128, 129, 66, 101

See application file for complete search history.

(56) References Cited

U.S. PATENT DOCUMENTS

| | | | | |
|---|---|---|---|---|
| 7,274,889 | B2 | 9/2007 | Furukawa | |
| 7,539,431 | B2 | 5/2009 | Watanabe et al. | |
| 2005/0074265 | A1 | 4/2005 | Furukawa | |
| 2008/0002997 | A1 | 1/2008 | Watanabe et al. | |
| 2008/0317506 | A1 * | 12/2008 | Furukawa | 399/223 |
| 2011/0064457 | A1 | 3/2011 | Okabe et al. | |
| 2011/0255889 | A1 * | 10/2011 | Ogiso et al. | 399/71 X |

FOREIGN PATENT DOCUMENTS

| | | | |
|---|---|---|---|
| JP | 2005-114975 | A | 4/2005 |
| JP | 2008-009427 | A | 1/2008 |
| JP | 2011-059510 | A | 3/2011 |

* cited by examiner

*Primary Examiner* — Sophia S Chen

(74) *Attorney, Agent, or Firm* — Banner & Witcoff, Ltd.

(57) ABSTRACT

An image forming apparatus includes: a first image forming unit for a monochrome printing including a first photosensitive member for black, a first charging member and a first collection member; a second image forming unit for a multicolor printing including a second photosensitive member for a color, a second charging member and a second collection member; and a control device configured to, at the color printing mode, apply a first charging bias to the second charging member and apply a first bias having a reverse polarity to a charged polarity of developer to the first and second collection members, and at the monochrome printing mode, apply a second charging bias to the second charging member, apply a second bias having the reverse polarity to the first collection member and apply a third bias to the second collection member.

8 Claims, 8 Drawing Sheets

FIG. 8A

MULTI-COLOR PRINTING MODE

| | BLACK | EXCEPT FOR BLACK |
|---|---|---|
| COLLECTION ROLLER | − | − |
| CHARGER | + + | + + |
| TRANSFER ROLLER | − | − |

FIG. 8B

FIRST CLEANING MODE

| | BLACK | EXCEPT FOR BLACK |
|---|---|---|
| COLLECTION ROLLER | + | + |
| CHARGER | + + | + + |
| TRANSFER ROLLER | − | − |

FIG. 8C

MONOCHROME PRINTING MODE

| | BLACK | EXCEPT FOR BLACK |
|---|---|---|
| COLLECTION ROLLER | − | + |
| CHARGER | + + | + |
| TRANSFER ROLLER | − | − − |

FIG. 8D

SECOND CLEANING MODE

| | BLACK | EXCEPT FOR BLACK |
|---|---|---|
| COLLECTION ROLLER | + | − |
| CHARGER | + + | + + |
| TRANSFER ROLLER | − | − |

IMAGE FORMING APPARATUS HAVING CONTROL DEVICE FOR APPLYING CONTROL BIASES TO COLLECTION MEMBERS

CROSS-REFERENCE TO RELATED APPLICATIONS

This application claims priority from Japanese Patent Application No. 2012-125849 filed on Jun. 1, 2012, the entire subject matter of which is incorporated herein by reference.

TECHNICAL FIELD

The invention relates to an image forming apparatus that transfers a developer image on a photosensitive member to a recording sheet.

BACKGROUND

There have been proposed an image forming apparatus of an electrophotographic type which has a plurality of photosensitive drums arranged in parallel, chargers charging the photosensitive drums, developing rollers supplying toners to the photosensitive drums, a conveyance belt conveying a recording sheet between the belt and the photosensitive drums, and the like. The related-art image forming apparatus is configured to switch a color mode, in which a color image is formed using all the photosensitive drums, and a monochrome mode, in which the developing rollers except for the developing roller for black are separated from the corresponding photosensitive drums and a monochrome image is formed using only the photosensitive drum for black provided at the most downstream side in a conveyance direction of the recording sheet.

Further, there have also been proposed another image forming apparatus of an electrophotographic type which has cleaning rollers for collecting toners attached (remaining) on the photosensitive drums and one constant voltage source for applying a bias voltage to the cleaning rollers.

SUMMARY

Illustrative aspects of the invention provide an image forming apparatus capable of suppressing paper dust from being fixed.

According to one illustrative aspect of the invention, there is provided an image forming apparatus comprising: a conveyance belt configured to convey a recording sheet; a first image forming unit configured to form a monochrome image at a monochrome printing mode, the first image forming unit comprising: a first photosensitive member for black configured to contact the conveyance belt; a first charging member configured to charge the first photosensitive member; and a first collection member configured to collect a substance attached on the first photosensitive member; a second image forming unit provided at a more upstream side than the first image forming unit in a moving direction of the conveyance belt and configured to form a multi-color image at a multi-color printing mode, the second image forming unit comprising: a second photosensitive member for a color except for black configured to contact the conveyance belt; a second charging member configured to charge the second photosensitive member; and a second collection member configured to collect a substance attached on the second photosensitive member; and a control device configured to control biases to be applied to the first charging member, the second charging member, the first collection member and the second collection member. At the color printing mode, the control device is configured to: apply a first charging bias to the second charging member; and apply a first bias having a reverse polarity to a charged polarity of developer to the first collection member and the second collection member. At the monochrome printing mode, the control device is configured to: apply a second charging bias having an absolute value smaller than that of the first charging bias to the second charging member; apply a second bias having a reverse polarity to the charged polarity of developer to the first collection member; and apply a third bias having the same polarity as the charged polarity of the developer to the second collection member.

BRIEF DESCRIPTION OF THE DRAWINGS

FIGS. 8A to 8D show polarities and magnitudes of biases that are applied to the developing rollers, chargers and transfer rollers, in which FIG. 8A shows the multi-color printing mode, FIG. 8B shows the first cleaning mode, FIG. 8C shows the monochrome printing mode and FIG. 8D shows the second cleaning mode.

DETAILED DESCRIPTION

<General Overview>

Figure 1:
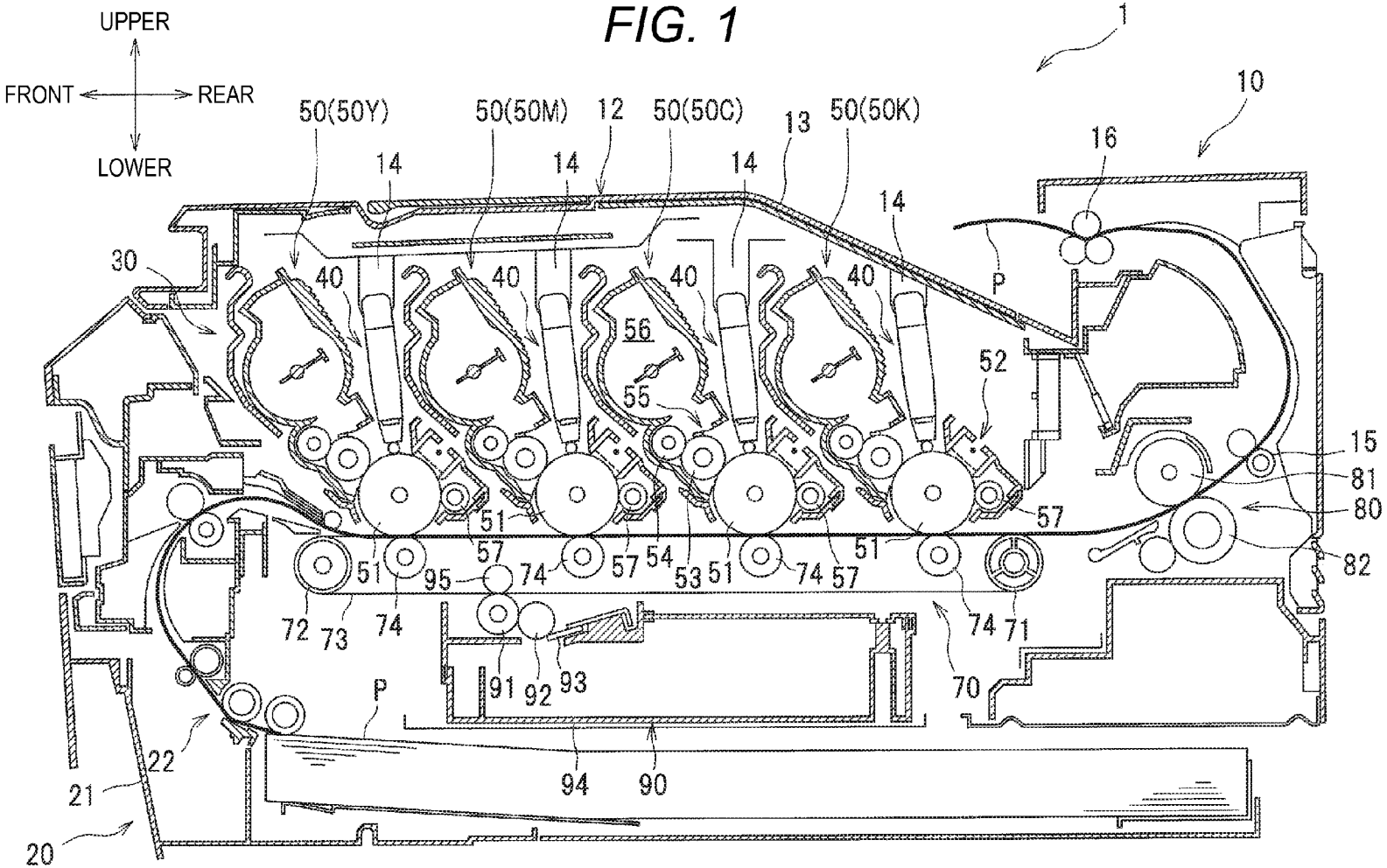
FIG. 1 shows a schematic configuration of a color printer that is an example of the image forming apparatus according to an exemplary embodiment of the invention.

In the related-art image forming apparatus where the photosensitive drum for black is provided at the most downstream side, when the monochrome mode is continuously executed, particularly, the paper dusts moved from the recording sheet still attach to the photosensitive drums except for the photosensitive drum for black, which are positioned at the upstream of the photosensitive drum for black. In some cases, the paper dust may be fixed on the photosensitive drums. This is considered to be caused because it is unable to collect the paper dust from the photosensitive drums except for the photosensitive drum for black at the monochrome mode.

That is, according to the configuration of the related-art image forming apparatus, a bias (a bias having a reverse polarity to a charged polarity of the toner) for collecting the toner is applied to the cleaning rollers except for the cleaning roller for black even at the monochrome mode where the cleaning rollers are not used for image formation, likewise the cleaning roller for black. Therefore, it is unable to collect the paper dusts, which attach onto the photosensitive drums except for the photosensitive drum for black and are charged to a reverse polarity to the charged polarity of the toner, by the cleaning rollers.

Further, since the developing rollers are separated from the photosensitive drums except for the photosensitive drum for black at the monochrome mode, it is unable to collect the paper dusts on the photosensitive drums except for the photosensitive drum for black by the developing rollers. This is also the same for a non-contact developing type.

Furthermore, the charging bias that is applied to the chargers except for the charger for black is suppressed for suppression of power consumption at the monochrome mode. Therefore, it is unable to charge the paper dusts, which attach on the photosensitive drums except for the photosensitive drum for black and are charged to the reverse polarity to the charged polarity of the toner, to the same polarity as the charged polarity of the toner. At the color mode where the chargers are used for image formation, it is possible to charge the paper dusts to the same polarity as the charged polarity of the toner by the chargers. Thus, like the toner, it is possible to collect the paper dusts by the cleaning rollers and the like. However, at the monochrome mode, it is unable to perform the collection.

When the paper dusts are fixed on the photosensitive drums, it is unable to favorably charge, expose and develop the part to which the paper dusts are fixed. Therefore, a quality of an image (e.g., image quality) that is formed on the recording sheet may be deteriorated.

Therefore, illustrative aspects of the invention provide an image forming apparatus capable of suppressing paper dust from being fixed.

According to one illustrative aspect of the invention, there is provided an image forming apparatus comprising: a conveyance belt configured to convey a recording sheet; a first image forming unit configured to form a monochrome image at a monochrome printing mode, the first image forming unit comprising: a first photosensitive member for black configured to contact the conveyance belt; a first charging member configured to charge the first photosensitive member; and a first collection member configured to collect a substance attached on the first photosensitive member; a second image forming unit provided at a more upstream side than the first image forming unit in a moving direction of the conveyance belt and configured to form a multi-color image at a multi-color printing mode, the second image forming unit comprising: a second photosensitive member for a color except for black configured to contact the conveyance belt; a second charging member configured to charge the second photosensitive member; and a second collection member configured to collect a substance attached on the second photosensitive member; and a control device configured to control biases to be applied to the first charging member, the second charging member, the first collection member and the second collection member. At the color printing mode, the control device is configured to: apply a first charging bias to the second charging member; and apply a first bias having a reverse polarity to a charged polarity of developer to the first collection member and the second collection member. At the monochrome printing mode, the control device is configured to: apply a second charging bias having an absolute value smaller than that of the first charging bias to the second charging member; apply a second bias having a reverse polarity to the charged polarity of developer to the first collection member; and apply a third bias having the same polarity as the charged polarity of the developer to the second collection member.

According to the above configuration, at the monochrome printing mode where the second photosensitive member is not used for image formation, the third bias having the same polarity as the charged polarity of the developer is applied to the second collection member. Therefore, it is possible to collect the paper dust by the second collection member, which is attached on the second photosensitive member and is charged to a reverse polarity to the charged polarity of the developer. Thereby, it is possible to suppress the paper dust from being still attached on the second photosensitive member, thereby suppressing the paper dust from being fixed. According thereto, it is possible to suppress an image quality from being deteriorated.

According to another illustrative aspect of the invention, the image forming apparatus further comprises: a first transfer member configured to attract a developer image on the first photosensitive member towards the conveyance belt; and a second transfer member configured to attract a developer image on the second photosensitive member towards the conveyance belt. The control device is configured to control transfer biases to be applied to the first transfer member and the second transfer member. At the monochrome printing mode, the control device is configured to apply a transfer bias having an absolute value larger than that of the multi-color printing mode to the second transfer member.

According to the above configuration, at the monochrome printing mode, the transfer bias having an absolute value larger than that of the multi-color printing mode is applied to the second transfer member. Therefore, it is possible to suppress a potential difference between the second photosensitive member and the second transfer member from being reduced even when the absolute value of the bias to be applied to the second charging member is decreased. Thereby, even at the monochrome printing mode where the absolute value of the bias to be applied to the second charging member is decreased, the paper dust is moved towards the second photosensitive member by the potential difference and is then collected by the second collection member. Hence, it is possible to suppress the paper dust from reaching the first photosensitive member arranged at the downstream side of the second photosensitive member.

According to still another illustrative aspect of the invention, the image forming apparatus further comprises: a belt cleaning member configured to collect the substance attached on the conveyance belt. After the monochrome printing mode is over, the control device is configured to execute a cleaning mode comprising: applying a fourth bias having the same polarity as the charged polarity of the developer to the first collection member for a first time period; moving the developer attached to the first collection member onto the conveyance belt through the first photosensitive member; and collecting the developer by the belt cleaning member. At the cleaning mode, the control device is configured to: apply a fifth bias having a reverse polarity to the charged polarity of the developer to the second collection member for a second time period; and apply a third charging bias having an absolute value larger than the second charging bias to the second charging member.

According to the above configuration, it is possible to collect the paper dust attached to the second collection member by the belt cleaning member, like the developer attached on the first collection member. That is, at the cleaning mode, the bias having the reverse polarity to the charged polarity of the developer is applied to the second collection member, so that the paper dust attached to the second collection member and charged to the reverse polarity to the charged polarity of the developer can be moved to the second photosensitive member. After that, the paper dust is charged to the same polarity as the charged polarity of the developer by the second charging member, to which the charging bias having the same polarity as the charged polarity of the developer and having an absolute value larger than that of the monochrome printing mode is applied. Hence, like the developer, the paper dust is moved from the second photosensitive member to the belt and is collected by the belt cleaning member.

According to still another illustrative aspect of the invention, the control device is configured such that the second time period is prolonged as the number of recording sheets to be printed at the just previous monochrome printing mode is larger.

According to the above configuration, when the number of the recording sheets printed at the just previous monochrome printing mode is large, much paper dusts are collected by the second collection member. Hence, when the second time is prolonged, it is possible to securely reduce the paper dusts attached on the second collection member, so that it is possible to favorably collect the paper dusts next time. Meanwhile, when the number of the recording sheets printed at the just previous monochrome printing mode is small, the second time is shortened. Therefore, it is possible to shorten the time that is consumed until a next printing mode is enabled.

According to still another illustrative aspect of the invention, the first collection member and the second collection member are rollers comprising at least a foamed elastic layer on an outer periphery thereof.

According to the above configuration, when collecting the developer or paper dust, the developer or paper dust attached on the photosensitive member can be scraped and securely collected by concave and convex portions of the surface of the foamed elastic layer. Thereby, it is possible to further securely suppress the image quality from being deteriorated, which is caused due to the developer or paper dust remaining on the photosensitive member.

According to still another illustrative aspect of the invention, the image forming apparatus further comprises: a plurality of the second image forming units; a first power supply configured to apply a bias to the first collection member; and one second power supply configured to apply a bias to each second collection member of the second image forming units.

According to the above configuration, compared to a configuration where the second power supply is individually provided for each of the second collection members, it is possible to implement the configuration where the paper dust is collected by the second collection member at the monochrome printing mode, at low cost.

According to still another illustrative aspect of the invention, the developer to be supplied to the first photosensitive member and the developer to be supplied to the second photosensitive member are positively charged developer.

According to still another illustrative aspect of the invention, there is provided an image forming apparatus comprising: a belt; a first image forming unit configured to form a monochrome image at a monochrome printing mode, the first image forming unit comprising: a first photosensitive member for black configured to contact the belt; and a first collection member configured to collect a substance attached on the first photosensitive member; a second image forming unit provided at a more upstream side than the first image forming unit in a moving direction of the belt and configured to form a multi-color image at a multi-color printing mode, the second image forming unit comprising: a second photosensitive member for a color except for black configured to contact the belt; and a second collection member configured to collect a substance attached on the second photosensitive member; and a control device configured to control biases to be applied to the first collection member and the second collection member. At the color printing mode, the control device is configured to apply a first bias having a reverse polarity to a charged polarity of developer to the first collection member and the second collection member. At the monochrome printing mode, the control device is configured to: apply a second bias having a reverse polarity to the charged polarity of developer to the first collection member; and apply a third bias having the same polarity as the charged polarity of the developer to the second collection member.

According to the invention, it is possible to positively collect the paper dust by the second collection member at the monochrome printing mode. Therefore, it is possible to suppress the paper dust from being still attached on the second photosensitive member, thereby suppressing the paper dust from being fixed.

<Exemplary Embodiments>

Hereinafter, exemplary embodiments of the invention will be described with reference to the accompanying drawings. Incidentally, in the below descriptions, a schematic configuration of a color printer 1, which is an example of the image forming apparatus according to an exemplary embodiment, will be briefly described and then a detailed configuration of the color printer 1 will be described. Further, in the below descriptions, the directions are described on the basis of a user who uses the color printer 1. That is, the left of FIG. 1 is referred to as the 'front,' the right of FIG. 1 is referred to as the 'rear,' the front side of FIG. 1 is referred to as the 'right' and the inner side of FIG. 1 is referred to as the 'left.' Further, the upper and lower directions of FIG. 1 are referred to as the 'upper-lower.'

(Schematic Configuration of Color Printer)

As shown in FIG. 1, the color printer 1 includes, in a body housing 10, a feeder unit 20 configured to feed a recording sheet P, an image forming unit 30 configured to form an image on the fed recording sheet P and a belt cleaning unit 90. An upper cover 12 is provided at an upper side of the body housing 10. The upper cover 12 is configured to be rotatable (openable/closeable) in the upper-lower direction at a rear side serving as a support point.

The feeder unit 20 is provided at the lower in the body housing 10. The feeder unit 20 includes a sheet feeding tray 21 configured to accommodate therein recording sheets P and a feeding mechanism 22 configured to feed the recording sheets P from the sheet feeding tray 21 to the image forming unit 30. The recording sheets P in the sheet feeding tray 21 are separated and fed one at a time to the image forming unit 30 by the feeding mechanism 22.

The image forming unit 30 includes four LED units 40, four process units 50, a transfer unit 70 and a fixing unit 80.

The LED unit 40 is arranged to face a photosensitive drum 51 from the upper of the photosensitive drum and has, at a lower end thereof, a plurality of LEDs (not shown) that is arranged in the left-right direction. The LED unit 40 is configured to expose a surface of the photosensitive drum 51 as a light emission unit thereof turns on and off on the basis of image data. Further, the LED unit 40 is held at the upper cover 12 via a holder 14 and is separated from the photosensitive drum 51 as the upper cover 12 is opened.

The process units 50 are arranged in parallel in the front-rear direction between the upper cover 12 and the sheet feeding tray 21 and are attached and detached to and from the body housing 10 at a state where the upper cover 12 is opened. Each process unit 50 includes the photosensitive drum 51, a charger 52, a developing roller 53, a supply roller 54, a layer thickness regulation blade 55, a toner accommodation part 56 configured to accommodate toner, which is an example of the developer, and a collection roller 57.

The process units 50 are arranged side by side from an upstream side (front side) of a conveyance direction of the recording sheet P in order of the process units 50Y, 50M, 50C, 50K in which yellow, magenta, cyan and black toners are respectively accommodated. All the toners of respective colors are positively charged. Incidentally, in the specification and drawings, when specifying the photosensitive drum 51, the charger 52 and the like corresponding to the color of the toner, the reference numerals Y, M, C, K are respectively denoted in correspondence to yellow, magenta, cyan and black.

The photosensitive drum 51 is a photosensitive member where a photosensitive layer is formed on a surface (outer peripheral surface) of a cylindrical drum body having conductivity and a conducting rotary shaft is grounded to the drum body. The charger 52 is a scorotron-type charger having a wire electrode, a grid electrode and the like (the reference numerals thereof are omitted) and is configured to generate a corona discharge by applying a charging bias, so as to charge the surface of the corresponding photosensitive drum 51 to a positive potential.

The collection roller 57 is a roller that is provided for each photosensitive drum 51 and is configured to temporarily collect (hold) a substance such as toner attached on the photosensitive drum 51 by applying a bias and to move the held substance to the photosensitive drum 51. Each collection roller 57 has a configuration where a metallic rotary shaft is covered with a roller body 571 made of a conductive foamed elastic body, e.g., a foamed elastic layer 572 is provided on an outer peripheral part.

The transfer unit 70 is provided between the feeder unit 20 and the process units 50. The transfer unit 70 includes a driving roller 71, a driven roller 72, a conveyance belt 73 and four transfer rollers 74.

The conveyance belt 73 is an endless belt for conveying the recording sheet P and is provided in a tensioned state between the driving roller 71 and the driven roller 72. An upper surface of an outer surface of the conveyance belt 73 is arranged to contact the respective photosensitive drums 51, and the respective transfer roller 74 are arranged to sandwich the conveyance belt 73 at an inside of the conveyance belt 73 between the transfer rollers 74 and the respective photosensitive drums 51. The transfer roller 74 is configured to attract a toner image (developer image) formed on the photosensitive drum 51 from the photosensitive drum 51 to the conveyance belt 73 (recording sheet P).

The fixing unit 80 is provided at the rear of the process units 50 and the transfer unit 70. The fixing unit 80 includes a heating roller 81 and a pressing roller 82 that is arranged to face the heating roller 81 and is configured to press the heating roller 81.

The belt cleaning unit 90 is provided below the conveyance belt 73. The belt cleaning unit 90 includes a first cleaning roller 91, a second cleaning roller 92 and a scraping blade 93, which are an example of the belt cleaning member, a toner storage part 94 and a backup roller 95 that is arranged to sandwich the conveyance belt 73 between the backup roller and the first cleaning roller 91.

The first cleaning roller 91 is a roller configured to collect the substance such as toner and paper dust attached on the conveyance belt 73 as a predetermined bias is applied between the first cleaning roller 91 and the backup roller 95. The first cleaning roller 91 has a configuration where a metallic rotary shaft is covered with a roller body made of a conductive foamed elastic body, e.g., a foamed elastic layer is provided on an outer peripheral part. Further, the second cleaning roller 92 is a metallic roller configured to collect the toner attached on the first cleaning roller 91. The scraping blade 93 is a member configured to scrape the toner attached on the second cleaning roller 92. The toner scraped from a surface of the second cleaning roller 92 by the scraping blade 93 is stored in the toner storage part 94.

(Detailed Configurations of Color Printer)

Figure 2:
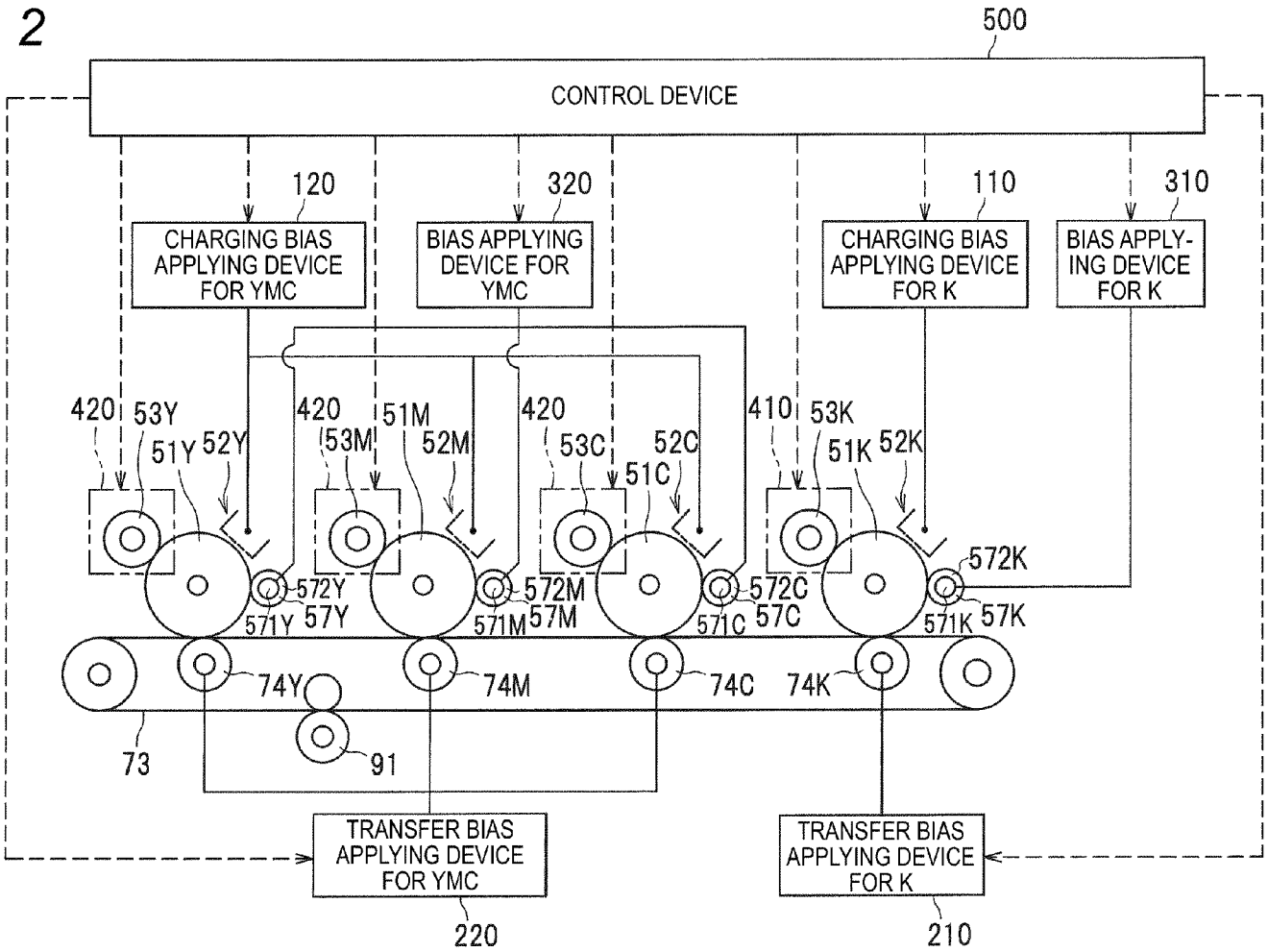
FIG. 2 shows a configuration of characteristic parts of the color printer.

In the below, detailed configurations of the color printer 1 relating to the features of the invention are described. As shown in FIG. 2, the color printer 1 further has a charging bias applying device for K 110, a charging bias applying device for YMC 120, a transfer bias applying device for K 210, a transfer bias applying device for YMC 220, a bias applying device for K 310 that is an example of the first power supply, a bias applying device for YMC 320 that is an example of the second power supply, a first contact/separation mechanism 410, a second contact/separation mechanism 420 and a control device 500.

Incidentally, in this exemplary embodiment, the process unit 50K that accommodates therein the black toner corresponds to the 'first image forming unit', the photosensitive drum 51K, the charger 52K and the collection roller 57K correspond to the 'first photosensitive member', the 'first charging member' and the 'first collection member', and the transfer roller 74K that is arranged to face the photosensitive drum 51K corresponds to the 'first transfer member.' Further, the process units 50Y, 50M, 50C that accommodate therein the yellow, magenta and cyan toners, respectively, correspond to the 'second image forming unit', the photosensitive drums 51Y, 51M, 51C, the chargers 52Y, 52M, 52C and the collection rollers 57Y, 57M, 57C correspond to the 'second photosensitive member', the 'second charging member' and the 'second collection member', and the transfer rollers 74Y, 74M, 74C that are arranged to face the photosensitive drums 51Y, 51M, 51C correspond to the 'second transfer member.'

The charging bias applying device for K 110 is a device (power supply) that is connected to the charger for black 52K (wire electrode) and is configured to apply a positive charging bias, which is the same polarity as a charged polarity of the toner, to the charger 52K. Further, the charging bias applying device for YMC 120 is a device (power supply) that is connected to the charger for yellow 52Y (wire electrode), the charger for magenta 52M (wire electrode) and the charger for cyan 52C (wire electrode), which are connected in parallel, and is configured to apply a common positive charging bias to the respective chargers 52Y, 52M, 52C.

The transfer bias applying device for K 210 is a device (power supply) that is connected to the transfer roller for black 74K and is configured to apply a negative transfer bias, which is a reverse polarity to a charged polarity of the toner, to the transfer roller 74K. Further, the transfer bias applying device for YMC 220 is a device (power supply) that is connected to the transfer roller for yellow 74Y, the transfer roller for magenta 74M and the transfer roller for cyan 74C, which are connected in parallel, and is configured to apply a common negative transfer bias to the respective transfer rollers 74Y, 74M, 74C.

The bias applying device for K 310 is a device (power supply) that is connected to the collection roller for black 57K and is configured to apply a bias to the collection roller 57K. Further, the bias applying device for YMC 320 is a device (power supply) that is connected to the collection roller for yellow 57Y, the collection roller for magenta 57M and the collection roller for cyan 57C, which are connected in parallel, and is configured to apply a common bias to the respective collection rollers 57Y, 57M, 57C.

The first contact/separation mechanism 410 is a mechanism that enables the developing roller 53K to contact or separate from the photosensitive drum 51K of the process unit 50K mounted to the body housing 10. Further, the second contact/separation mechanism 420 is a mechanism that enables the corresponding developing rollers 53Y, 53M, 53C to contact or separate from the photosensitive drums 51Y, 51M, 51C of the process units 50Y, 50M, 50C mounted to the body housing 10.

Incidentally, since the respective bias applying devices and the respective contact/separation mechanisms can adopt the well-known configurations, the detailed configurations thereof are omitted in the specification.

The control device 500 is a device configured to control operations of the color printer 1 by controlling the respective units of the color printer 1, specifically, the feeder unit 20, the image forming unit 30, the first contact/separation mechanism 410, the second contact/separation mechanism 420 and the like. The control device 500 is arranged at an appropriate position in the body housing 10. Further, the control device 500 is configured to control the charging bias applying device for K 110, the charging bias applying device for YMC 120, the transfer bias applying device for K 210, the transfer bias applying device for YMC 220, the bias applying device for K 310 and the bias applying device for YMC 320, thereby controlling the bias to be applied to the chargers 52, the collection rollers 57 and the transfer rollers 74. The control device 500 includes a CPU, a RAM, a ROM, an I/O interface and the like, which are not shown, and is configured to execute respective calculation processing based on detection results of various sensors, preset programs and the like, thereby executing the control.

In this exemplary embodiment, the control device 500 is configured to mainly execute a multi-color printing mode of forming a multi-color image (color image) on a recording sheet P, a monochrome printing mode of forming a monochrome image on the recording sheet P, a first cleaning mode that is executed after the multi-color printing mode is over and a second cleaning mode that is the cleaning mode of the invention, which is executed after the monochrome printing mode is over. In the below, the control of the control device 500 and the operations of the color printer 1 at the respective modes are described.

[Multi-Color Printing Mode]

When a print job including image data of a color image is input from an external apparatus such as personal computer (not shown), the control device 500 executes the multi-color printing mode. Specifically, as shown at time til in FIG. 3, the control device 500 rotates (ON) the photosensitive drums 51, the collection rollers 57, the conveyance belt 73 and the like.

Further, the control device 500 is configured to control the bias applying device for K 310 and the bias applying device for YMC 320 to thus apply the negative bias (first bias) to the respective collection rollers 57, control the charging bias applying device for K 110 and the charging bias applying device for YMC 120 to thereby apply the positive charging bias (first charging bias) to the respective chargers 52 and control the transfer bias applying device for K 210 and the transfer bias applying device for YMC 220 to thus apply the negative transfer bias to the respective transfer rollers 74.

Thereby, while the remaining transfer toners on the respective photosensitive drums 51 being rotated are collected by the corresponding collection rollers 57, the surfaces of the respective photosensitive drums 51 are uniformly positively charged by the corresponding chargers 52. After that, the respective photosensitive drums 51 are exposed by the LED units 40, so that electrostatic latent images based on the image data are formed on the respective photosensitive drums 51 in correspondence to colors of the toners.

Further, at this time, the toners in the respective toner accommodation parts 56 are positively friction-charged, are supplied to the developing rollers 53 through the supply rollers 54, are introduced between the developing rollers 53 and the layer thickness regulation blades 55 and are carried on the developing rollers 53 as thin layers having a predetermined thickness. The black toner is supplied from the developing roller 53K to the exposed part of the photosensitive drum 51K, so that the electrostatic latent image becomes visible and a black toner image is formed on the photosensitive drum 51K. Likewise, the toners of respective colors are supplied from the developing rollers 53Y, 53M, 53C to the exposed parts of the corresponding photosensitive drums 51Y, 51M, 51C, so that the electrostatic latent images become visible and yellow, magenta and cyan toner images are formed on the photosensitive drums 51Y, 51M, 51C. At appropriate timing up to now, the control device 500 controls the feeder unit 20 so as to feed the recording sheet P to the image forming unit 30.

The fed recording sheet P is conveyed between the photosensitive drums 51 and the conveyance belt 73 (the transfer rollers 74 to which the negative transfer bias is applied) by the conveyance belt 73. At this time, the toner images on the photosensitive drums 51 are sequentially transferred with being overlapped onto the recording sheet P from the respective process units 50. The recording sheet P having the toner images transferred thereto is conveyed between the heating roller 81 and the pressing roller 82, so that the toner images are heat-fixed. Thereby, a color image is formed on the recording sheet P. The recording sheet P having the color image formed thereon is discharged to an outside from the body housing 10 by conveyance rollers 15 and discharge rollers 16 and is then put on a sheet discharge tray 13.

When the image formation for all the image data included in the print job is completed, the control device 500 controls the bias applying device for K 310 and the bias applying device for YMC 320 to thus stop applying the bias to the respective collection rollers 57, controls the charging bias applying device for K 110 and the charging bias applying device for YMC 120 to thereby stop applying the charging bias and controls the transfer bias applying device for K 210 and the transfer bias applying device for YMC 220 to thus stop applying the transfer bias. Then, the control device 500 stops (OFF) the rotation driving of the photosensitive drums 51 and the like and ends the multi-color printing mode (time t12).

[First Cleaning Mode]

When the multi-color printing mode is over, the control device 500 executes the first cleaning mode (cleaning mode after the multi-color printing mode). Specifically, after the multi-color printing mode is over, the control device 500 controls the first contact/separation mechanism 410 and the second contact/separation mechanism 420 to thus separate all the developing rollers 53 from the photosensitive drums 51 as shown in FIG. 4 from the state shown in FIG. 2 (time t12 to t13 in FIG. 3).

Figure 3:
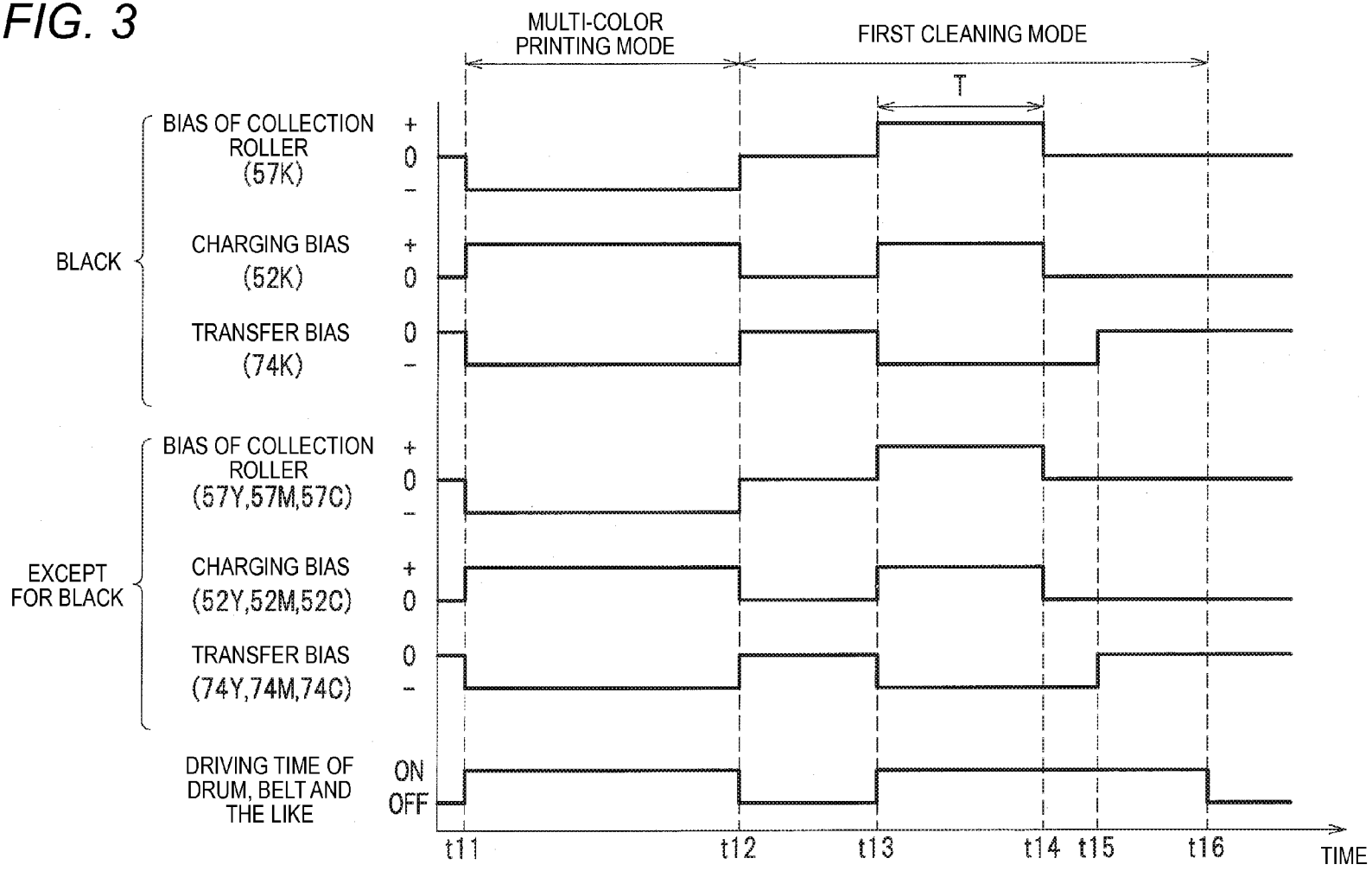
FIG. 3 is time charts showing control of the color printer at a multi-color printing mode and at a first cleaning mode.
Figure 4:
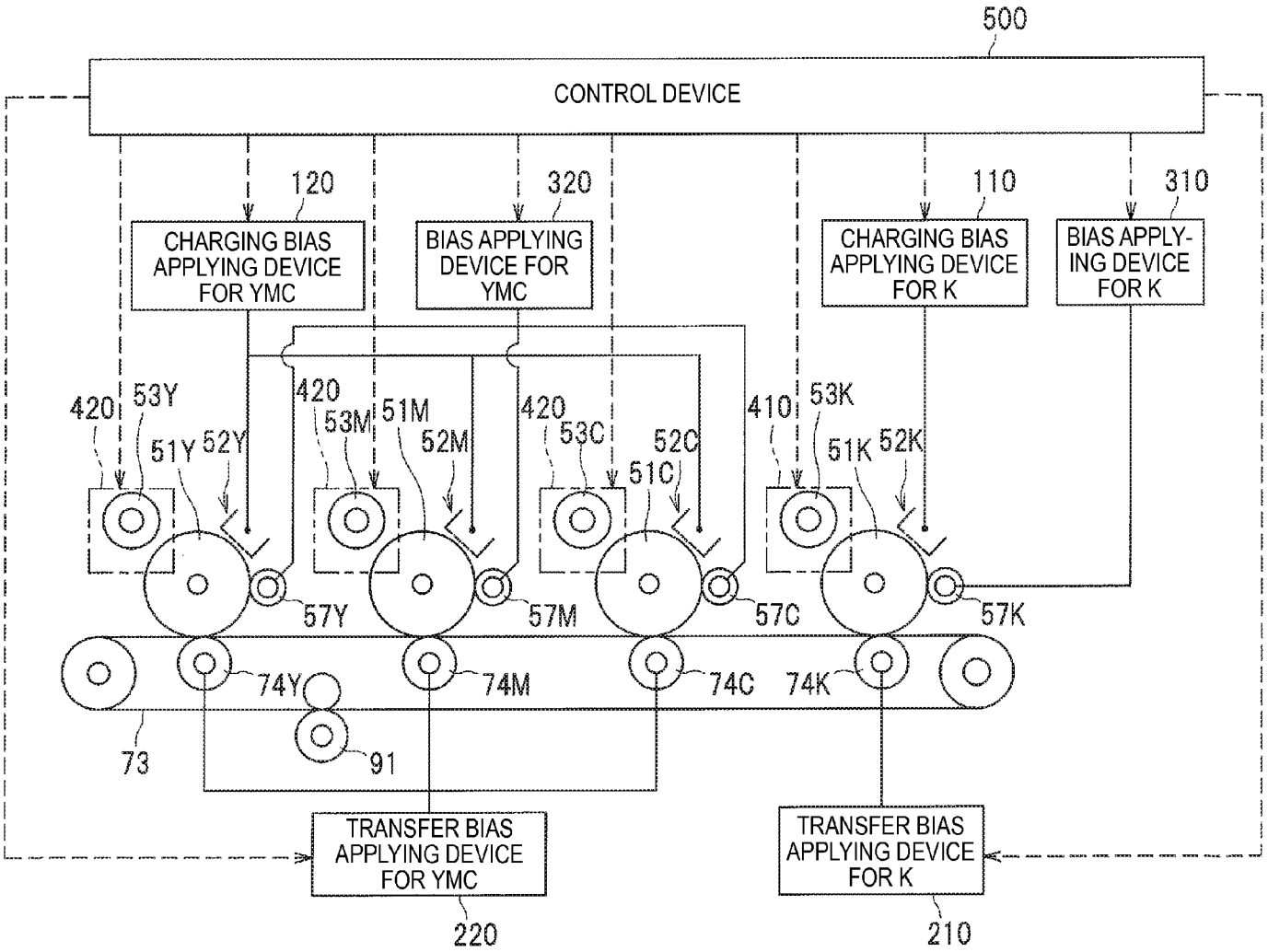
FIG. 4 shows the configuration of the characteristic parts of the color printer when all developing rollers are separated.

After that, as shown at time t13 of FIG. 3, the control device 500 rotates (ON) the photosensitive drums 51, the collection rollers 57, the conveyance belt 73 and the like. Further, the control device 500 controls the bias applying device for K 310 and the bias applying device for YMC 320 to thus apply the positive bias to the respective collection rollers 57, controls the charging bias applying device for K 110 and the charging bias applying device for YMC 120 to thereby apply the same positive charging bias as that of the multi-color printing mode (image formation) to the respective chargers 52 and controls the transfer bias applying device for K 210 and the transfer bias applying device for YMC 220 to thus apply the same negative transfer bias as that of the image formation to the respective transfer rollers 74.

Thereby, the toners attached on the collection rollers 57 are moved from the collection rollers 57 to the photosensitive drums 51, the remaining transfer toners attached on the photosensitive drums 51 or toners moved from the collection rollers 57 are moved towards the conveyance belt 73 and are collected by the belt cleaning unit 90 as the conveyance belt 73 is rotated.

The control device 500 applies the positive bias to the respective collection rollers 57 for predetermined time T (time t13 to t14) to thus move the toners attached on the respective collection rollers 57 to the photosensitive drums 51. After the predetermined time T elapses, the control device 500 controls the bias applying device for K 310 and the bias applying device for YMC 320 to thus stop applying the bias to the respective collection rollers 57 and controls the charging bias applying device for K 110 and the charging bias applying device for YMC 120 to thereby stop applying the charging bias (time t14).

After that, at least after a time period elapses during which the toners, which have been moved from the collection rollers 57 towards the photosensitive drums 51 just before the applying of the bias to the respective collection rollers 57 is stopped, are moved to between the photosensitive drums 51 and the conveyance belt 73, the control device 500 controls the transfer bias applying device for K 210 and the transfer bias applying device for YMC 220 to stop the applying of the transfer bias (time t15). Then, at least after a time period elapses during which the toners, which have been moved from the photosensitive drums 51 towards the conveyance belt 73 just before the applying of the transfer bias is stopped, are collected by the belt cleaning unit 90, the control device 500 stops (OFF) the driving of the conveyance belt 73 and the like and then ends the first cleaning mode (time t16).

[Monochrome Printing Mode]

When a print job including image data of a monochrome image is input from the external apparatus, the control device 500 executes the monochrome printing mode.

Figure 5:
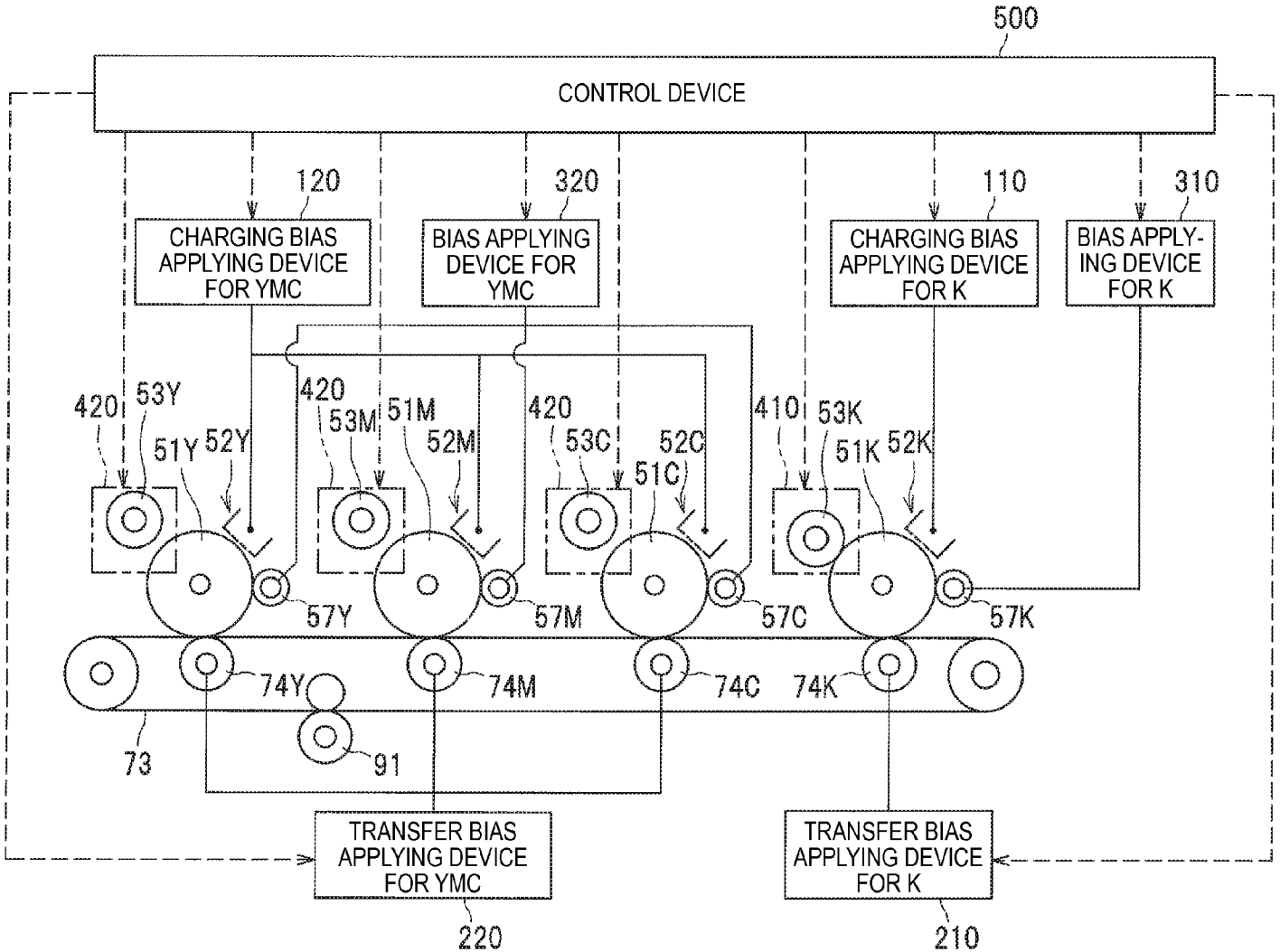
FIG. 5 shows the configuration of the characteristic parts of the color printer when the developing rollers, except for the developing roller for black, are separated.

Specifically, the control device 500 controls the second contact/separation mechanism 420 to thus separate the developing rollers 53Y, 53M, 53C from the photosensitive drums 51Y, 51M, 51C from the state shown in FIG. 2, as shown in FIG. 5.

Figure 6:
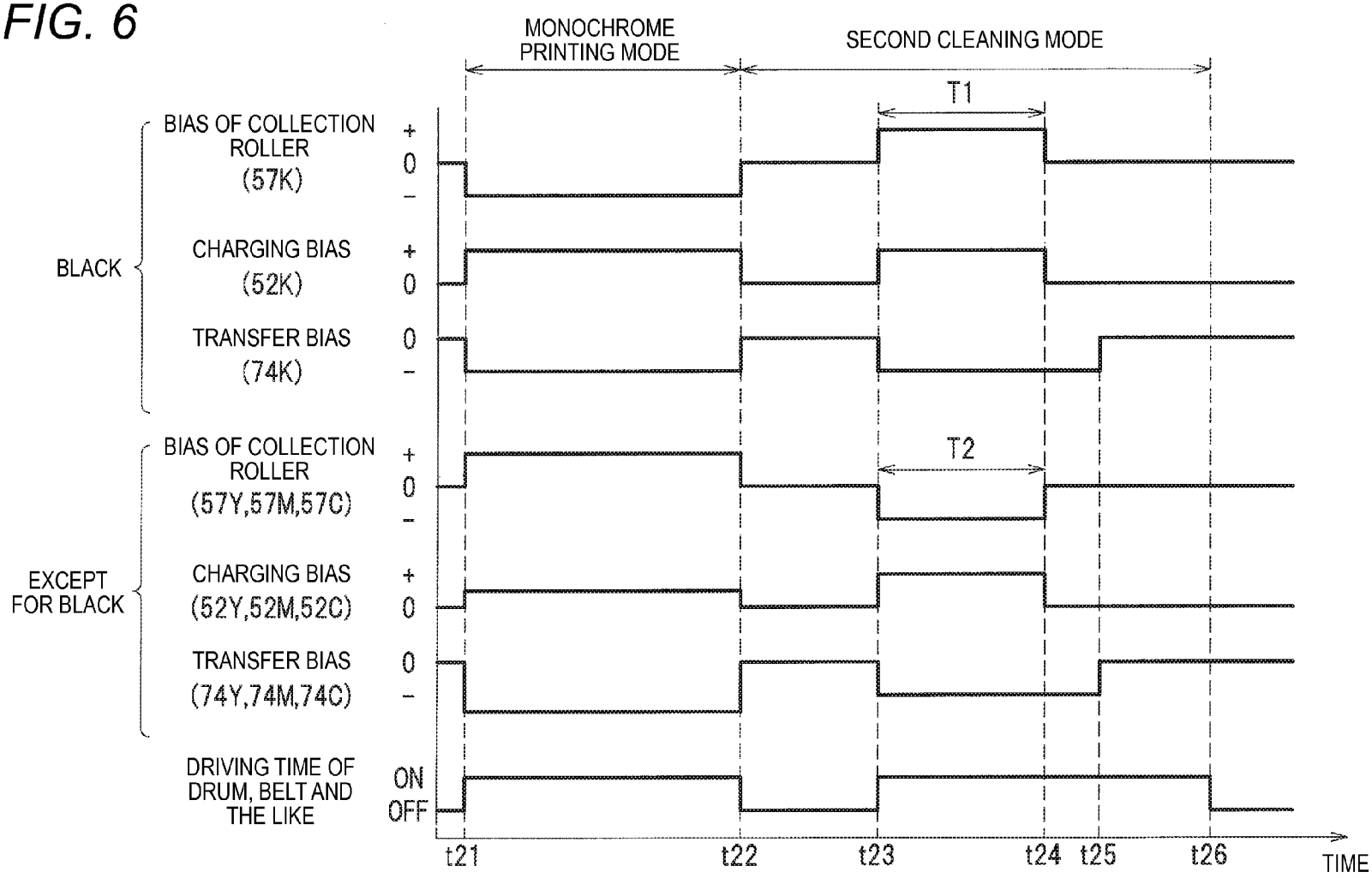
FIG. 6 is time charts showing control of the color printer at a monochrome printing mode and at a second cleaning mode.

Then, as shown at time t21 of FIG. 6, the control device 500 rotates (ON) the photosensitive drums 51, the collection rollers 57, the conveyance belt 73 and the like. Further, the control device 500 controls the bias applying device for K 310 to thus apply the negative bias (second bias) to the collection roller 57K, controls the charging bias applying device for K 110 to thereby apply the positive charging bias to the charger 52K and controls the transfer bias applying device for K 210 to thus apply the negative transfer bias to the transfer roller 74K.

Thereby, while the remaining transfer toner on the photosensitive drum 51K being rotated is collected by the collection roller 57K, the surface of the photosensitive drum 51K is uniformly positively charged by the charger 52K. After that, like the multi-color printing mode, the photosensitive drum 51K is exposed by the LED unit 40, so that an electrostatic latent image based on the image data is formed thereon. The black toner is supplied from the developing roller 53K to the electrostatic latent image, so that a black toner image is formed on the photosensitive drum 51K. Then, the recording sheet P that is fed from the feeder unit 20 is conveyed between the photosensitive drum 51K and the conveyance belt 73 (the transfer roller 74K to which the negative transfer bias is applied), so that the black toner image on the photosensitive drum 51K is transferred onto the recording sheet P from the process unit 50K. The recording sheet P having the toner image transferred thereto is conveyed between the heating roller 81 and the pressing roller 82, so that the toner image is heat-fixed. Thereby, a monochrome image is formed on the recording sheet P. The recording sheet P having the image formed thereon is discharged to the outside from the body housing 10 and is then put on the sheet discharge tray 13.

Meanwhile, during the above process, the control device 500 controls the charging bias applying device for YMC 120 to thus apply a positive charging bias (second charging bias), which is lower than that of the multi-color printing mode (image formation), to the chargers 52Y, 52M, 52C that are not used for the above monochrome image formation. Thereby, while the surfaces of the photosensitive drums 51Y, 51M, 51C are positively charged with the lower potential, the power consumption of the chargers 52Y, 52M, 52C is suppressed and the ozone that is generated by the corona discharge is suppressed. However, in this case, since it is unable to positively charge the paper dusts, which are attached from the recording sheet P onto the photosensitive drums 51Y, 51M, 51C and are negatively charged, by the chargers 52Y, 52M, 52C, the paper dusts may still attach on the photosensitive drums 51Y, 51M, 51C.

Hence, the control device 500 controls the bias applying device for YMC 320 at the monochrome mode, thereby applying the positive bias (third bias) to the collection rollers 57Y, 57M, 57C (time t21). Thereby, it is possible to collect (hold) the negatively charged paper dusts attached on the photosensitive drums 51Y, 51M, 51C by the collection rollers 57Y, 57M, 57C.

Further, at this time, the control device 500 controls the transfer bias applying device for YMC 220 to thus apply a negative transfer bias, which has an absolute value larger than that of the multi-color printing mode, to the transfer rollers 74Y, 74M, 74C (time t21). Thereby, even when the positive charging bias that is applied to the charger 52Y, 52M, 52C is low, it is possible to suppress a potential difference between the photosensitive drums 51Y, 51M, 51C and the corresponding transfer rollers 74Y, 74M, 74C from being decreased. Therefore, the paper dusts are moved from the recording sheet P to the photosensitive drums 51Y, 51M, 51C by the potential difference and are then collected by the collection rollers 57Y, 57M, 57C.

When the image formation for all the image data included in the print job is completed, the control device 500 controls the bias applying device for K 310, the charging bias applying device for K 110, the transfer bias applying device for K 210, the bias applying device for YMC 320, the charging bias applying device for YMC 120 and the transfer bias applying device for YMC 220 to thus stop the applying of the respective biases. Then, the control device 500 stops (OFF) the rotation of the photosensitive drums 51 and the like and ends the monochrome printing mode (time t22).

[Second Cleaning Mode]

When the monochrome printing mode is over, the control device 500 executes the second cleaning mode (cleaning mode after the monochrome printing mode).

Specifically, after the monochrome printing mode is over, the control device 500 controls the first contact/separation mechanism 410 to thus separate the developing roller 53K from the photosensitive drum 51K as shown in FIG. 4 from the state shown in FIG. 5 (time t22 to t23 in FIG. 6). Thereby, all the developing rollers 53 are separated from the corresponding photosensitive drums 51.

After that, as shown at time t23 of FIG. 6, the control device 500 rotates (ON) the photosensitive drums 51, the collection rollers 57, the conveyance belt 73 and the like. Further, the control device 500 controls the bias applying device for K 310 to thus apply the positive bias (fourth bias) to the collection roller 57K, controls the bias applying device for YMC 320 to thereby apply the negative bias (fifth bias) to the collection rollers 57Y, 57M, 57C, controls the charging bias applying device for K 110 and the charging bias applying device for YMC 120 to thus apply the same positive charging bias as that of the image formation to the respective chargers 52 and controls the transfer bias applying device for K 210 and the transfer bias applying device for YMC 220 to thus apply the same negative transfer bias as that of the image formation to the respective transfer rollers 74. Making an additional remark, at the second cleaning mode, the control device 500 controls the charging bias applying device for YMC 120 to thus apply the positive charging bias (third charging bias), which is higher than the charging bias that is applied at the monochrome printing mode, to the chargers 52Y, 52M, 52C.

Thereby, the positively charged remaining transfer toner attached on the collection roller 57K is moved from the collection roller 57K, to which the positive bias (fourth bias) is applied, to the photosensitive drum 51K. In the meantime, the negatively charged paper dusts attached on the collection rollers 57Y, 57M, 57C are moved from the collection rollers 57Y, 57M, 57C to the corresponding photosensitive drums 51Y, 51M, 51C and the paper dusts on the photosensitive drums 51Y, 51M, 51C are positively charged by the corresponding chargers 52Y, 52M, 52C, to which the positive charging bias higher than that of the monochrome printing mode is applied. The positively charged toners or paper dusts attached on the photosensitive drums 51 are attracted to the transfer rollers 74 to which the negative transfer bias is applied, moved towards the conveyance belt 73 and finally collected by the belt cleaning unit 90.

The control device 500 applies the positive bias to the collection roller 57K for first time T1 to thus move the toner attached on the collection roller 57K to the photosensitive drum 51K. Further, the control device 500 applies the negative bias to the collection rollers 57Y, 57M, 57C for second time T2 to thus move the paper dusts attached on the collection rollers 57Y, 57M, 57C to the corresponding photosensitive drums 51Y, 51M, 51C. Incidentally, in this exemplary embodiment, the first time T1 and the second time T2 are the same (refer to time t23 to t24). Alternatively, the first T1 and the second time T2 may be different.

After the time T1, T2, the control device 500 stops applying the bias to the respective collection rollers 57 and applying the charging bias to the respective chargers 52 (time t24), like the first cleaning mode. Then, the control device 500 stops applying the transfer bias to the respective transfer rollers 74 (time t25), stops (OFF) the driving of the conveyance belt 73 and the like and ends the second cleaning mode (time t26).

Incidentally, the second time T2 may be a preset fixed value or may be varied depending on conditions. For example, the control device 500 may be configured such that, as the number of the recording sheets P printed at the just previous monochrome printing mode is large, the second time T2 is prolonged. More specifically, the control device 500 may be configured such that, when the number of the recording sheets P printed at the just previous monochrome printing mode is larger than a preset threshold value, the control device 500 prolongs the second time T2, compared to a case where it is smaller than the threshold value. According to this configuration, when the number of the recording sheets P printed at the just previous monochrome printing mode is large, much paper dusts are collected by the collection rollers 57Y, 57M, 57C. Hence, when the second time T2 is prolonged, it is possible to securely reduce the paper dusts attached on the collection rollers 57Y, 57M, 57C, so that it is possible to favorably collect the paper dusts at a next monochrome printing mode. Further, when the number of the recording sheets P printed at the just previous monochrome printing mode is small, the second time T2 is shortened. Therefore, it is possible to shorten the time that is consumed until a next printing mode is enabled.

(Control of Color Printer)

A series of control flows of the color printer 1 by the control device 500 are described with reference to FIGS. 7 and 8. Incidentally, in FIG. 8, '+' in a row of the charger indicates a bias that is lower than '++', and '−−' in a row of the transfer roller indicates a bias that is smaller (an absolute value thereof is larger) than '−'.

Figure 7:
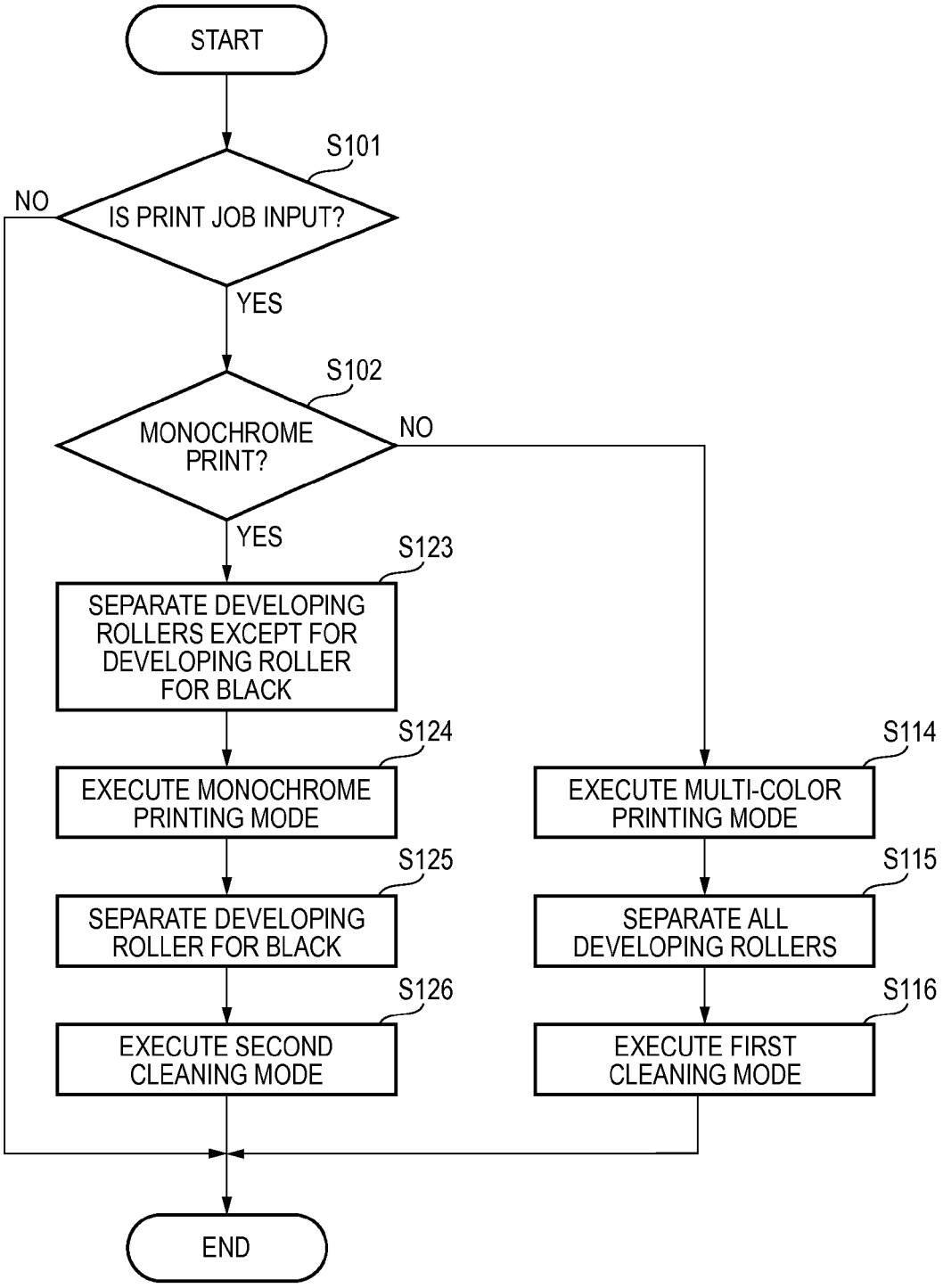
FIG. 7 is a flowchart showing the control of the color printer.

The control device 500 repeatedly executes processing of a flowchart shown in FIG. 7. Specifically, the control device 500 determines whether a print job is input (S101). When a print job is not input (No), the control device 500 ends the processing of the flowchart shown in FIG. 7. When a print job is input (Yes), the control device 500 determines whether the input print job is a print job of a monochrome image (S 102).

When the input print job is not a print job of a monochrome image (S102, No), that is, when the input print job is a print job of a color image, the control device 500 executes the multi-color printing mode (S 114). At this time, as shown in FIG. 8A, since the negative (−) bias is applied to the respective collection rollers 57, the positively charged toners remaining on the photosensitive drums 51 are collected by the collection rollers 57.

After the printing is over, the control device 500 separates all the developing rollers 53 from the corresponding photosensitive drums 51 (S115) and executes the first cleaning mode (S116). At this time, as shown in FIG. 8B, since the positive (+) bias is applied to the respective collection rollers 57, the positively charged toners attached on the collection rollers 57 are moved onto the corresponding photosensitive drums 51.

After that, the remaining transfer toners attached on the photosensitive drums 51 or toners moved from the collection rollers 57 are collected by the belt cleaning unit 90 through the conveyance belt 73. After the cleaning is over, the control device 500 ends the processing of the flowchart shown in FIG. 7. Incidentally, in this exemplary embodiment, after the cleaning is over, the control device 500 controls the first contact/separation mechanism 410 and the second contact/separation mechanism 420 to thus bring the respective developing rollers 53 into contact with the corresponding photosensitive drums 51.

On the other hand, when it is determined in step S102 that the input print job is a print job of a monochrome image (Yes), the control device 500 separates the developing rollers 53Y, 53M, 53C, except for the developing roller for black 53K, from the corresponding photosensitive drums 51Y, 51M, 51C (S123) and executes the monochrome printing mode (S124). At this time, as shown in FIG. 8C, since the negative (−) bias (first bias) is applied to the collection roller for black 57K, the positively charged toner remaining on the photosensitive drum 51K is collected by the collection roller 57K. Further, since the positive (+) bias (second bias) is applied to the collection rollers 57Y, 57M, 57C, except for the collection roller for black 57K, the negatively charged paper dusts attached onto the photosensitive drums 51Y, 51M, 51C from the recording sheet P are collected by the corresponding collection rollers 57Y, 57M, 57C.

Further, at this time, since the charging bias (first charging bias), which is applied to the chargers 52Y, 52M, 52C, except for the charger for black 52K that are not used for image formation, is lower (+) than that (++) of the multi-color printing mode, it is possible to save the power of the color printer 1 while positively charging the surfaces of the photosensitive drums 51Y, 51M, 51C. Further, at the monochrome printing mode where the charging bias to be applied to the chargers 52Y, 52M, 52C is decreased, the negative (−−) transfer bias having a larger absolute value is applied to the transfer rollers 74Y, 74M, 74C, except for the transfer roller for black 74K. Therefore, it is possible to suppress the potential difference between the photosensitive drums 51Y, 51M, 51C and the corresponding transfer rollers 74Y, 74M, 74C from being decreased and to move the paper dusts from the recording sheet P to the photosensitive drums 52Y, 52M, 52C by the potential difference.

After the printing is over, the control device 500 separates the developing roller 53K for black from the photosensitive drum 51K (S125) and executes the second cleaning mode (S126). At this time, as shown in FIG. 8D, since the positive (+) bias (third bias) is applied to the collection roller for black 57K, the positively charged toner attached on the collection roller 57K is moved onto the photosensitive drum 51K. Further, since the negative (−) bias (fourth bias) is applied to the collection rollers 57Y, 57M, 57C, except for the collection roller for black 57K, the negatively charged paper dusts attached on the collection rollers 57Y, 57M, 57C are moved onto the corresponding photosensitive drums 51Y, 51M, 51C. Further, the paper dusts on the photosensitive drums 51Y, 51M, 51C are charged to a reverse polarity (positive) by the chargers 52Y, 52M, 52C to which the positive (+) charging bias (second charging bias) higher than that of the monochrome printing mode is applied.

After that, like the first cleaning mode, the positively charged toners or paper dusts attached on the photosensitive drums 51 are collected by the belt cleaning unit 90 through the conveyance belt 73. After the cleaning is over, the control device 500 ends the processing of the flowchart shown in FIG. 7.

In this exemplary embodiment, following operational effects may be obtained.

In the color printer 1, at the monochrome printing mode where the photosensitive drums 51Y, 51M, 51C are not used for the image formation, the positive bias that is the same polarity as the charged polarity of the toner is applied to the collection rollers 57Y, 57M, 57C. Therefore, it is possible to collect the paper dusts, which are charged to the negative polarity that is the reverse polarity to the charged polarity of the toners, by the collection rollers 57Y, 57M, 57C. Thereby, it is possible to suppress the paper dusts from being still attached on the photosensitive drums 51Y, 51M, 51C, thereby suppressing the paper dusts from being fixed. As a result, it is possible to suppress the image quality from being deteriorated, which is caused due to the attachment or fixing of the paper dusts.

Specifically, in this exemplary embodiment, the bias applying device for K 310 and the bias applying device for YMC 320 are separately provided. Therefore, it is possible to easily implement the configuration (control) where the negative bias, which is the reverse polarity to the charged polarity of the toner, is applied to the collection roller 57K and the positive bias, which is the same polarity as the charged polarity of the toner, is applied to the collection rollers 57Y, 57M, 57C at the monochrome printing mode.

Further, in the configuration where the process units 50Y, 50M, 50C are arranged at the more upstream side than the process unit 50K in the moving direction of the upper surface of the conveyance belt 73, it is possible to collect the paper dusts on the photosensitive drums 51Y, 51M, 51C at the upstream side, thereby suppressing the paper dusts from reaching the photosensitive drum 51Y at the downstream side. Thereby, it is possible to suppress the image quality from being degraded, which is caused due to the attachment of the paper dusts on the photosensitive drum 51K having a higher use frequency.

Further, in this exemplary embodiment, at the monochrome printing mode where the charging bias to be applied to the chargers 52Y, 52M, 52C is decreased, the absolute value of the transfer bias that is applied to the transfer rollers 74Y, 74M, 74C is increased. Therefore, it is possible to suppress the potential difference between the photosensitive drums 51Y, 51M, 51C and the corresponding transfer rollers 74Y, 74M, 74C from being decreased, to move the paper dusts to the photosensitive drums 51Y, 51M, 51C by the potential difference and to collect the same by the collection rollers 57Y, 57M, 57C. In other words, in this exemplary embodiment, even at the monochrome printing mode where the charging bias to be applied to the chargers 52Y, 52M, 52C is decreased, it is possible to keep the potential difference between the photosensitive drums 51Y, 51M, 51C and the corresponding transfer rollers 74Y, 74M, 74C, thereby suppressing the paper dusts from reaching the photosensitive drum 51K.

Incidentally, at the monochrome printing mode, the control device 500 may be configured to further increase the absolute value of the transfer bias, which is applied to the transfer rollers 74Y, 74M, 74C, thereby increasing the potential difference between the photosensitive drums 51Y, 51M, 51C and the corresponding transfer rollers 74Y, 74M, 74C, compared to that of the multi-color printing mode. According to this configuration, since the paper dusts can be easily moved towards the photosensitive drums 51Y, 51M, 51C at the monochrome printing mode where the paper dusts on the photosensitive drums 51Y, 51M, 51C are collected by the collection rollers 57Y, 57M, 57C, it is possible to further suppress the paper dusts from reaching the photosensitive drum 51K.

Further, in this exemplary embodiment, since the collection roller 57 has the foamed elastic layer on the outer periphery thereof, it is possible to scrape and securely collect the toner or paper dust attached to the photosensitive drum 51 by convex and concave portions of the surface of the foamed elastic layer. Thereby, particularly during the printing, it is possible to further securely suppress the image quality from being deteriorated, which is caused due to the toner or paper dust remaining on the photosensitive drum 51. Further, since the first cleaning roller 91 also has the foamed elastic layer on the outer periphery, it is possible to scrape and securely collect the toner or paper dust attached to the conveyance belt 73.

Further, in this exemplary embodiment, one bias applying device for YMC 320 applies the bias to the three collection rollers 57Y, 57M, 57C. Therefore, compared to a configuration where bias applying devices (power supplies) are respectively provided in correspondence to the respective collection rollers 57Y, 57M, 57C, it is possible to implement the configuration where the paper dusts are collected by the collection rollers 57Y, 57M, 57C at the monochrome printing mode, at low cost.

Although the exemplary embodiment of the invention has been described, the invention is not limited to the exemplary embodiment. The specific configurations can be appropriately changed without departing from the scope of the invention.

In the above-described exemplary embodiment, the control device 500 controls the first contact/separation mechanism 410 and the second contact/separation mechanism 420 to thus bring the respective developing rollers 53 (developer carriers) into contact with the corresponding photosensitive drums 51 (photosensitive members) after the cleaning is over. However, the invention is not limited thereto. For example, the image forming apparatus may be configured so that the developing roller is separated from the corresponding photosensitive drum at an input standby state of a print job. The control device may be configured to control the first contact/separation mechanism and the second contact/separation mechanism to thus bring all the developing rollers into contact with the corresponding photosensitive members at the multi-color printing mode and to control the first contact/separation mechanism to thus bring only the developing roller for black into contact with the first photosensitive member at the monochrome printing mode.

In the above-described exemplary embodiment, the collection roller 57 has a configuration where the entire roller body is formed of the foamed elastic material. However, the invention is not limited thereto. That is, the collection roller 57 may have a configuration where a foamed elastic layer is provided on at least the outer periphery. For example, only a surface of the roller body may be formed of the foamed elastic material. Further, the roller body of the collection roller 57 may be formed of rubber and the like. This is also the same for the first cleaning roller 91 serving as the belt cleaning member.

In the above-described exemplary embodiment, the configuration having the first cleaning roller 91, the second cleaning roller 92 and the scraping blade 93 has been exemplified as the belt cleaning member. However, the invention is not limited thereto. For example, the belt cleaning member may consist of only the scraping blade.

In the above-described exemplary embodiment, the color printer 1 (image forming apparatus) is configured to collect the toners or paper dusts, which have been collected by the collection rollers 57, by the belt cleaning unit 90 through the photosensitive drums 51 and the conveyance belt 73 at the cleaning mode. However, the invention is not limited thereto. For example, the image forming apparatus may be configured to collect the developer or paper dust, which has been moved from the collection member onto the photosensitive member, by the developing roller and the like. Further, the image forming apparatus may be configured to collect the developer or paper dust, which has been collected by the collection member, by a roller, a blade and the like contacting the collection member. Incidentally, according to the above configuration where the belt cleaning unit 90 is provided, as the above exemplary embodiment, it is not necessary to provide the process units 50 with a space and the like for accommodating the collected toners or paper dusts. Therefore, it is possible to miniaturize and simplify the process unit 50, which is a replaceable part, and to reduce the cost thereof.

In the above-described exemplary embodiment, only one bias applying device for YMC 320 (second power supply) is provided which applies the bias to the respective collection rollers 57Y, 57M, 57C (second collection member) of the process units 50Y, 50M, 50C. However, the invention is not limited thereto. For example, the second power supply may be individually provided in correspondence to each of the second collection members. That is, the second power supply may be provided in plural.

In the above-described exemplary embodiment, the scorotron type charger 52 has been exemplified as the charging member. However, the invention is not limited thereto. For example, the charger may be a corotron type charger having no grid electrode, a pin array charger having needle-shaped electrodes that are arranged in line, instead of the wire electrodes, or a charging roller.

In the above-described exemplary embodiment, the color printer 1 (printer) has been exemplified as the image forming apparatus. However, the invention is not limited thereto. For example, a copier, a multi-function device and the like having a document reading apparatus such as flat bed scanner may be also possible. Further, in the above exemplary embodiment, the color printer 1 (image forming apparatus) is configured to form a multi-color image by using all the process units 50 (both the first image forming unit and the second image forming unit) at the multi-color printing mode. However, the invention is not limited thereto. For example, the image forming apparatus may be configured to form a multi-color image by using only the second image forming unit except for the process unit for black at the multi-color printing mode. Further, in the above exemplary embodiment, the image forming apparatus in which the plurality of second image forming units (process units 50Y, 50M, 50C) is provided has been exemplified. However, the invention is not limited thereto. For example, an image forming apparatus in which only one second image forming unit is provided may be also possible. Further, in the above exemplary embodiment, the image forming apparatus of the contact developing type in which the toner is supplied to the photosensitive drum 51 from the developing roller 53 contacting the photosensitive drum 51. However, the invention is not limited thereto. For example, an image forming apparatus of a non-contact developing type may be also possible.

In the above-described exemplary embodiment, the toners of respective colors (the developer to be supplied to the first photosensitive member and the developer to be supplied to the second photosensitive member) are positively charged. However, the invention is not limited thereto. For example, the black developer and the developer of a color except for black may be negatively charged. In this case, the polarity (positive and negative) of each bias is reverse to that of the above exemplary embodiment and the magnitude of the bias is a magnitude of an absolute value thereof. Further, the paper dust that is collected by the second collection member is positively charged.

What is claimed is:

1. An image forming apparatus comprising:

a conveyance belt configured to convey a recording sheet;

a first image forming unit configured to form a monochrome image at a monochrome printing mode, the first image forming unit comprising:

a first photosensitive member for black configured to contact the conveyance belt;

a first charging member configured to charge the first photosensitive member; and a first collection member configured to collect a substance attached on the first photosensitive member;

a second image forming unit provided at a more upstream side than the first image forming unit in a moving direction of the conveyance belt and configured to form a multi-color image at a multi-color printing mode, the second image forming unit comprising:

a second photosensitive member for a color except for black configured to contact the conveyance belt;

a second charging member configured to charge the second photosensitive member; and a second collection member configured to collect a substance attached on the second photosensitive member; and a control device configured to control biases to be applied to the first charging member, the second charging member, the first collection member and the second collection member, wherein at the color printing mode, the control device is configured to:

apply a first charging bias to the second charging member; and apply a first bias having a reverse polarity to a charged polarity of developer to the first collection member and the second collection member, and wherein at the monochrome printing mode, the control device is configured to:

apply a second charging bias having an absolute value smaller than that of the first charging bias to the second charging member;

apply a second bias having a reverse polarity to the charged polarity of developer to the first collection member; and apply a third bias having the same polarity as the charged polarity of the developer to the second collection member.

2. The image forming apparatus according to claim 1, further comprising:

a first transfer member configured to attract a developer image on the first photosensitive member towards the conveyance belt; and a second transfer member configured to attract a developer image on the second photosensitive member towards the conveyance belt, wherein the control device is configured to control transfer biases to be applied to the first transfer member and the second transfer member, and wherein at the monochrome printing mode, the control device is configured to apply a transfer bias having an absolute value larger than a transfer bias to be applied at of the multi-color printing mode to the second transfer member.

3. The image forming apparatus according to claim 1, further comprising:

a belt cleaning member configured to collect the substance attached on the conveyance belt, wherein after the monochrome printing mode is over, the control device is configured to execute a cleaning mode comprising:

applying a fourth bias having the same polarity as the charged polarity of the developer to the first collection member for a first time period;

moving the developer attached to the first collection member onto the conveyance belt through the first photosensitive member; and collecting the developer by the belt cleaning member, and wherein at the cleaning mode, the control device is configured to:

apply a fifth bias having a reverse polarity to the charged polarity of the developer to the second collection member for a second time period; and apply a third charging bias having an absolute value larger than the second charging bias to the second charging member.

4. The image forming apparatus according to claim 3, wherein the control device is configured such that the second time period is prolonged as the number of recording sheets to be printed at the just previous monochrome printing mode increases.

5. The image forming apparatus according to claim 1, wherein the first collection member and the second collection member are rollers comprising at least a foamed elastic layer on an outer periphery thereof.

6. The image forming apparatus according to claim 1, further comprising:

a plurality of the second image forming units;

a first power supply configured to apply a bias to the first collection member; and one second power supply configured to apply a bias to each second collection member of the second image forming units.

7. The image forming apparatus according to claim 1, wherein the developer to be supplied to the first photosensitive member and the developer to be supplied to the second photosensitive member are positively charged developer.

8. An image forming apparatus comprising:

a belt;

a first image forming unit configured to form a monochrome image at a monochrome printing mode, the first image forming unit comprising:

a first photosensitive member for black configured to contact the belt; and a first collection member configured to collect a substance attached on the first photosensitive member;

a second image forming unit provided at a more upstream side than the first image forming unit in a moving direction of the belt and configured to form a multi-color image at a multi-color printing mode, the second image forming unit comprising:

a second photosensitive member for a color except for black configured to contact the belt; and a second collection member configured to collect a substance attached on the second photosensitive member; and a control device configured to control biases to be applied to the first collection member and the second collection member, wherein at the color printing mode, the control device is configured to apply a first bias having a reverse polarity to a charged polarity of developer to the first collection member and the second collection member, and wherein at the monochrome printing mode, the control device is configured to:

apply a second bias having a reverse polarity to the charged polarity of developer to the first collection member; and apply a third bias having the same polarity as the charged polarity of the developer to the second collection member.

* * * * *